US005954431A

United States Patent [19]

Fabel

[11] Patent Number: 5,954,431

[45] **Date of Patent: *Sep. 21, 1999**

[54] TRANSPARENT SECURITY POCKET COMPATIBLE WITH NON-IMPACT PRINTERS

[75] Inventor: Warren M. Fabel, Delray Beach, Fla.

[73] Assignee: Laser Substrates, Inc., Boca Raton, Fla.

[ * ] Notice: This patent is subject to a terminal disclaimer.

[21] Appl. No.: 08/349,062

[22] Filed: Dec. 1, 1994

[51] Int. Cl.[6] ..... B65D 33/34; B65D 33/04

[52] U.S. Cl. ..... 383/5; 383/84; 383/106; 383/209; 229/71; 229/80; 229/313

[58] Field of Search ..... 383/62, 5, 84, 383/106, 207, 209; 229/71, 80, 69, 313

[56] References Cited

U.S. PATENT DOCUMENTS

| | | | |
|---|---|---|---|
| 3,140,816 | 7/1964 | Schultz | 229/69 |
| 3,150,473 | 9/1964 | Lemelson | 229/71 X |
| 4,308,988 | 1/1982 | Jiveman et al. | 229/69 X |
| 4,371,489 | 2/1983 | McGrail | 264/129 |
| 4,468,811 | 8/1984 | Shaw et al. | 383/84 X |
| 4,473,153 | 9/1984 | Colangelo | 229/68.1 X |
| 4,549,658 | 10/1985 | Sfikas | 383/5 X |
| 4,570,416 | 2/1986 | Shoenfeld | 229/71 X |
| 4,785,940 | 11/1988 | Wilson | 383/5 X |
| 4,895,297 | 1/1990 | Klamm | 229/71 X |
| 4,934,587 | 6/1990 | McNabb | 229/71 |
| 5,030,189 | 7/1991 | Hightower | 383/84 X |
| 5,255,785 | 10/1993 | Mackey | 229/82 X |
| 5,791,553 | 8/1998 | Fabel | 229/92.3 X |

FOREIGN PATENT DOCUMENTS

| | | | |
|---|---|---|---|
| 2145997 | 4/1985 | United Kingdom | 383/5 |

*Primary Examiner*—Jes F. Pascua
*Attorney, Agent, or Firm*—Ted W. Whitlock

[57] ABSTRACT

A security pocket has a front, transparent panel and a back panel, capable of being printed upon. Three sides of the perimeter of the two panels is permanently bonded, leaving a top opening into the pocket. The back panel includes a closure flap, which carries a permanent, pressure sensitive adhesive and, a tear strip. The front panel includes a removable strip, coextensive with the closure flap, which includes a layer of silicone release material facing the adhesive material. After the pocket is filled, the removable strip is removed and the closure flap is folded over and permanently sealed to the front panel. The transparent panel is a plastic film having significant antistatic properties which enables the flat, empty, two ply pocket to be fed through a sheet fed non-impact printer, without formation of excess static electricity.

4 Claims, 1 Drawing Sheet

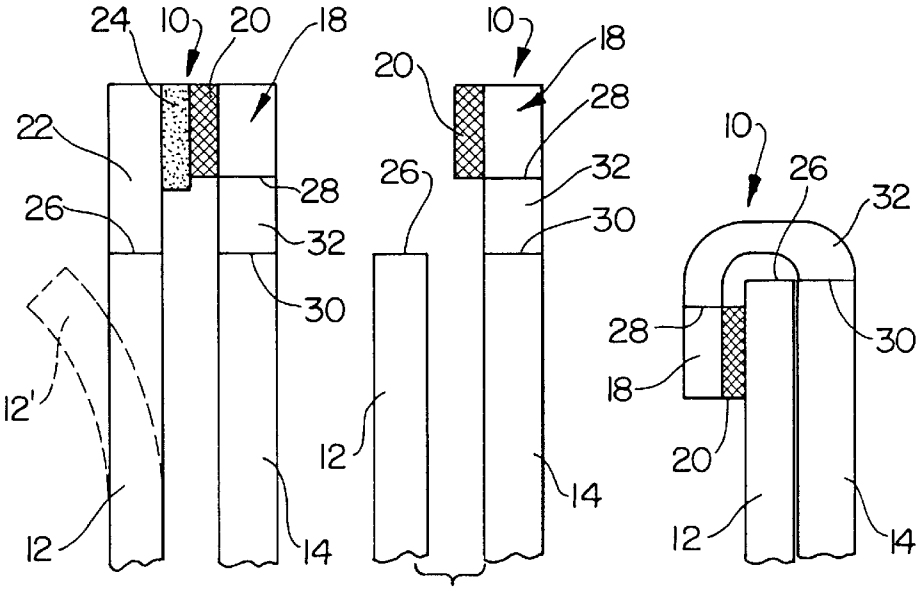
FIG. 2A
FIG. 2B
FIG. 2C
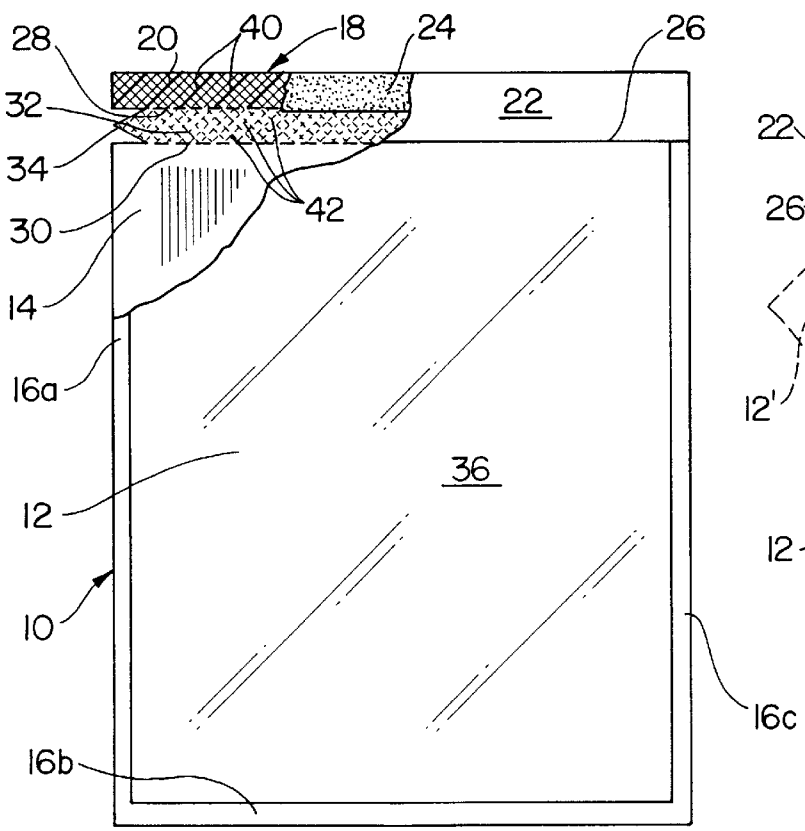
FIG. 1
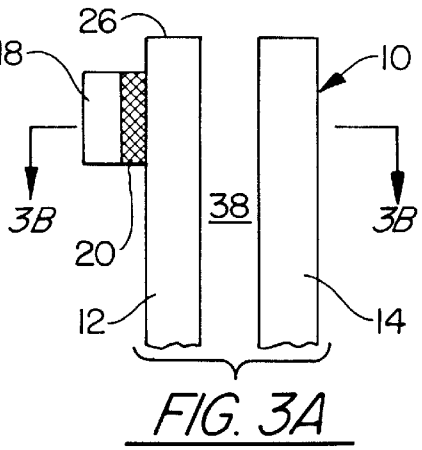
FIG. 3A
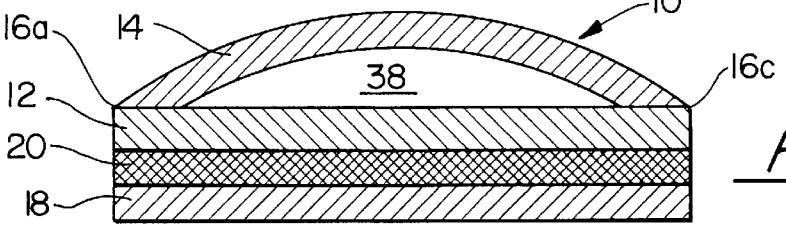
FIG. 3B

TRANSPARENT SECURITY POCKET COMPATIBLE WITH NON-IMPACT PRINTERS

BACKGROUND OF THE INVENTION

1. Field of the Invention

This invention concerns security pockets useful for holding and transporting small objects, such as: pharmaceutical pills, syringes, etc.; jewelry and jewels; and other small, valuable items transported within a manufacturing environment. These security pockets also carry printed information concerning: their contents, how to use, for whom the pocket is designated, and so forth.

2. Background Information

Security pockets have been in use for many years. Typically, one side or face of the pocket is substantially transparent to define a clear substrate for easy viewing of the contents of the pocket. The other side, or back, of the pocket is of paper or like material, defining a panel capable of having information written or printed thereon. Typically, security pockets are rectangular and are formed by gluing three edges of a clear film or plastic substrate to the similar three edges of the back panel; thus leaving their fourth edges available for insertion therebetween of the items to be held in the two ply laminate pocket. After items are placed into the pocket, the fourth edges are sealed together. The business form industry is the usual source of security pockets of the type to which this invention is directed.

An important user of security pockets is the hospital pharmacy, which receives orders for and then dispenses a very wide range of prescriptions, to be used within the hospital. The number of items (pills, vials, etc.), their proper dosage, the patient's name, room, nursing station, doctors name, etc., need to be identified on the paper panel, back side of the pocket. Also, the pocket contents need to be viewable, through the transparent face substrate of the pocket, for verification of the continuing correctness of the contents, when compared with the prescription information on the back side of the security pocket. Such comparison should occur each time that the pocket moves from the pharmacy to another site: via a transporting hospital aide, to the nursing station, to the dispensing R.N., etc. At each "step" along the way, the hospital employee handling the security pocket is to examine the pocket for security verification. Has the pocket been torn open, or an edge slit open, or has there even been any attempt of tampering? If the security pocket has been "violated" in any manner, the employee takes required safety precautions, at least including a return of the pocket to the pharmacy control center for a refilling of the prescription in a new security pocket.

Security pockets also are used for movement of jewelry, loose jewels and parts of jewelry within the environment of jewelry repair and jewelry manufacturers. As another example, the integrity and safety of some small, valuable electronic parts can benefit from the use of security pockets within the manufacturing and transporting facilities.

From the above Background introduction, it now should be appreciated that a transparent security pocket needs to be of suitable construction and materials to facilitate easy handling, provide difficulty in security violation, and permit easy detection of tampering. Although such goals are easily appreciated, they have not been fully achieved heretofore. For example, the affixing of the clear, plastic substrate to the paper panel back side has been primarily accomplished heretofore by pressure sensitive glue or heat sealing. Pressure sensitive glues permits slight shifting of the laminae parts to enable flat fanfold packs, but this causes insufficient bonding of the edges of the two laminae. Hence, an edge or corner of the clear substrate can be lifted manually from the back panel, sufficiently to remove or contaminate the pocket contents; and then the opened corner or edge of the pocket easily can be resealed manually without any evidence of tampering. Heat sealing limits the use of the security pocket to low heat applications, thereby preventing the passage of the security pocket through, for example, laser printers or copy machines.

Heretofore, the information on the back panel has been hand written, or manually typewritten; or the empty pocket is fed through an automated printer of the impact type, often a "form fed" impact printer. However, to achieve: reduction in printing noise, increased clarity of print, printing of bar codes, and higher speed printing, non-impact printers, e.g. ink jet and laser printers, preferably sheet fed, have been considered and heretofore attempted without success. Non-impact printing introduces problems not yet solved and possibly not even fully recognized by the prior art manufacturers and users of security pockets.

One problem is that the electrical corona of laser printers forms an electric capacitor between the plastic/paper laminate of the pocket. Such capacitor can hold a relatively high voltage, which can present a discharge shock hazard to the operator. The corona of the laser also generates static electricity, which causes jamming of the security pockets at both the input and output feeding sides of the printer.

There also is generated static electricity by the feeding, sliding of the clear plastic substrate of one pocket over the paper panel of the next to be fed pocket in the input stack of the printer. Similarly, static electricity is formed on/at the output stack, as the pocket slides out from the printer and onto the output stack. The thus generated static charges cause severe feed jamming at both the input and output sides of the non-impact, sheet fed printer.

Additionally, laser printing includes a high temperature print fixing stage, approximately 400° F. (205° C.). This heat causes the prior art plastic film substrate to shrink; hence, the film acquires a smaller surface area than the paper panel to which it is secured. This causes a curling of the two ply laminate security pocket, which leads to output side printer feed jams.

SUMMARY OF THE INVENTION

In accordance with one aspect of this invention, there is provided a transparent security pocket including a front, transparent panel having antistatic properties and a rear panel bonded to said front panel. The rear panel is capable of being printed upon.

BRIEF DESCRIPTION OF THE DRAWINGS

One preferred embodiment of the subject invention is hereafter described, with specific reference being made to the following Figures, in which, FIG. 1 is a front plan view of the transparent security pocket of the subject invention, partly broken out, to expose elements the front surface;

FIG. 2A shows the pocket in its initial, open top condition;

FIG. 2B illustrates the condition after the silicon release carrying strip is removed from the front, transparent panel to expose the closure flap;

FIG. 2C illustrates the pocket top sealed by the closure flap;

FIG. 3A shows the reopened pocket, after the tear strip of the closure flap is removed; and FIG. 3B shows the top view of FIG. 3A in cross section across line 3B—3B, with the back panel bowed for removal of objects from the security pocket.

DETAILED DESCRIPTION

Generally, the present invention is a transparent security pocket defined by a two ply laminate construction, one ply forming a substantially transparent front side and the other ply being the back side and capable of being printed upon, preferably by a non-impact printer. The two plies are relatively thin, are of the same shape and surface area, are superimposed, and have a significant portion of their peripheral edges permanently bonded together when delivered to the user. The opposing peripheral edge portions, which are not permanently bonded, define the mouth opening into the pocket. The top most surface of the back side is to form the closure flap and carries a permanent pressure sensitive adhesive strip. The corresponding, facing surface of the transparent ply carries a coating of silicon release material, so that it will not adhere to the adhesive strip. That portion of the front ply carrying the silicon release is removable, so that, after the pocket is filled, the release strip is removed, exposing the pressure sensitive adhesive carrying closure flap, which then can be folded over the top edge of the front ply of the pocket and permanently seal thereupon. Preferably, the transparent front ply is of a unique polyester film, which is coated to eliminate static electricity. The material of the front ply is chosen to be resistant to shrinkage due to heating in the laser printer.

Referring to FIG. 1, a transparent security pocket 10 of this invention is shown in plan view and can be of various shapes and sizes to meet the needs of the user; such needs often dictated by the size, shape and quantity of items to be contained and protected by security pocket 10. Likewise, the strength of the two plies of the pocket will depend upon the weight and shape of the contained items and also the modes by which security pocket 10 is filled and then is transported, before being reopened. In addition, security panel 10 should be thin enough to be usable with commercially available sheet fed non-impact printers without causing paper feeding problems.

For directness of description and ease of illustration, security pocket 10 is of rectangular shape, as shown in FIG. 1. A front, transparent panel 12 can be of any material having sufficient transparency and flexibility, as long as such material also can be subject to the perimeter bonding and closure flap sealing described hereinafter. A thin transparent plastic film can serve well for front panel 12 for many utilizations or constructions of security pocket 10. However, a unique film will be identified hereafter for its special features for an enhanced security pocket compatible with non-impact, sheet fed printers.

A back panel 14 of security pocket 10 is of the same size and rectangular shape as front panel 12. It need not be a transparent material and, where panel 12 is intended to carry written or printed information regarding the items to be secured within security pocket 10, or their destination and/or use, a paper type material is preferred for back panel 14.

Three sides of the periphery, or perimeter, of security pocket 10 is permanently sealed, and leaving the unsealed one side of the periphery as the opening into security pocket 10. In FIG. 1, the permanently sealed perimeter portions are designated 16*a,* 16*b,* and 16*c* and form three sides of security pocket 10. There is an available choice of glues, adhesives and bonding materials, depending upon the material used for front transparent panel 12 and back panel 14. Hot melt glues and adhesives, which are dried by ultraviolet exposure, are two general types of permanent bonding substances. A preferred adhesive will be disclosed hereinbelow.

The top of back panel 14 includes several components, which define a closure flap 18 and serves as the opening into security pocket 10. Along the top edge of closure flap 18 of back panel 14, on the interior facing side thereof, is a layer of permanent, pressure sensitive adhesive 20. Adhesive 20 is prevented from permanently bonding to the interior facing side of a front flap 22 on the top of front transparent panel 12 by a protecting strip 24, which may be a layer of silicon release material applied to the topmost interior facing edge of front flap 22. As is well known in the art, when silicon release material 24 is placed against adhesive 20, a non-permanent bond results, which permits the user to peel away the silicon release material and anything affixed thereto, such as front flap 22. Of particular note, however, is the fact that when security panel 10 is assembled as seen in FIG. 1, all four edges of security panel 10 are sealed, three permanently and one non-permanently.

Referring additionally to FIGS. 2A, 2B and 2C, the bottom edge of front flap 22 is defined by a die cut line 26 entirely through transparent front panel 12. In initially using security pocket 10, the desired items are placed therein through the opening formed by die cut line 26, and by moving front panel 12 away from back panel 14 to the position 12' at die cut line 26, as shown in FIG. 2A by the dashed lines. After the desired items are placed in security pocket 10, front flap 22 is then removed from front panel 12, by being pulled off along die cut line 26. This action results the configuration shown in FIG. 2B, where permanent, pressure sensitive adhesive 20 is exposed. Thereafter, as seen in FIG. 2C, the remaining closure flap 18 is bent over and secured against transparent front panel 12 by application of a slight pressure.

Referring again to FIG. 1, and particularly the broken out segment thereof exposing rear panel 14 and closure flap 18, there are two perforation lines 28 and 30, which run parallel to one other across the width of closure flap 18 and define therebetween a tear strip 32. A tab 34 is formed at least at one end of tear strip 32, for manual grasping to aid in the removal of tear strip 32. Perforation line 30 is aligned with die cut line 26 between front panel 12 and front flap 22, as seen from FIGS. 2A and 2B, and perforation line 28 is positioned at or below the lower boundary of adhesive strip 20. As shown in FIG. 2C, when adhesive strip 20 is secured to front panel 14, it is placed slightly below die cut line 26, forming the top edge of front panel 12, and tear strip 32, defined by perforation lines 28 and 30, is positioned between the upper edge of adhesive 20 and the exposed die cut top edge 26 of transparent panel 12. It is to be remembered that tear strip 32 does not carry any adhesive.

Security pocket 10 now is ready to be handled or transported, as required. If there is any attempt to tamper with the contents of security pocket 10, it would have to be done by either tearing along one or more of the permanently sealed perimeter parts 16*a,* 16*b* or 16*c,* cutting through front or back panels 12 and 14, cutting a slit below permanently sealed closure flap 18, or at least partially tearing open the top of security pocket 10, via tear strip 32. Any or all such violations of security pocket 10 would be easily noticed by an employee entrusted to security pocket 10 control soon after such violation. Hence, the intended end user or recipient of the contents of security pocket 10 would not suffer from use of a contaminated or substituted substance. Moreover, the ease of detecting tampering or violating the security of security pocket 10 would discourage such activity.

Once intact security pocket 10 reaches its final destination, its top is opened easily by manual removal of tear strip 32, resulting in the configuration shown in FIG. 3A, which permits front and back panels 12 and 14 to be bowed apart, as shown in FIG. 3B, with perimeters 16*a,* 16*b* and 16*c* remaining sealed.

Referring again to FIG. 1, a further enhancement to the security aspects of security pocket 10 can be provided by placing striations 40 the paper to which pressure sensitive adhesive 20 is affixed, as shown in part in the broken out section of closure flap 18 in FIG. 1. Striations 40 will cause closure flap 18 to fracture, if an attempt is made to defeat the integrity of sealed closure flap 18. Such fracturing can be detected easily by a visual or tactile inspection.

Tear strip 32 can be enhanced by being reinforced. One such reinforcement can be accomplished by applying a fibrous coating 42 to tear strip 32. Such coating can contain short fibers in a lacquer type vehicle, as taught in U.S. patent application Ser. No. 08/240,869, filed May 10, 1994 and entitled "Mailing Form For Non-Impact Printing"; and assigned to the Assignee of the present Application. Where tear strip 32 is along the grain of the paper of back panel 14, a lacquer or varnish coat will suffice as the reinforcement.

The adhesive used to bond the two plies 12 and 14 along periphery 16*a,* 16*b,* 16*c* of security pocket 10 must be compatible with the materials of both panels 12 and 14 and must be resistant to softening by the heat used to fuse the toner to security pocket 10 in a laser printer. Since back panel 14 typically is to be printed upon directly, it conveniently would be paper, such as a 50 to 60 pound offset sheet, which poses minor problems in selecting a bonding adhesive. Front panel 12, which is to be transparent material, such as a plastic film, requires an adhesive which has sufficient affinity to ensure a secure seal between transparent panel 14 and paper back panel 12. As will be detailed hereinbelow, a preferred plastic film is a coated polyester. One adhesive suitable for the intended bonding of front and back panels 12 and 14 is a polyvinyl acetate resin emulsion #1-916, manufactured by Beaver Adhesives, Inc., 4400 Edgewyn Ave., Hilliard, Ohio 43026. This adhesive adheres so well to the polyester transparent film that an attempt to split the bonding of the two panels 12 and 14 would cause the paper of panel 14 to tear, before the bond could be separated, thereby providing notice of tampering of the security pocket. Adequate bonding of panels 12 and 14 also can be obtained by using a permanent hot melt glue.

The permanent, pressure sensitive adhesive strip 20 on closure flap 18 can be obtained from various sources. One such adhesive and its source are Skelbond$^{(R)}$ 114 UV Adhesive, sold by Energetic Chemical Specialties, Inc., 1 Main Street, Eatontown, N.J. 07724.

Silicon release material 24, on the front flap 22 of transparent panel 12 needs to be compatible with the material of transparent panel 12, for example a polyester film. Release product components, manufactured by GE Silicones division of General Electric Company, U.S.A., yield such a compatible release. More Specifically, the use of UV9400 solventless UV release polymer, in combination with UV9380C or UV9310C photocatalysts, can be photocured in air, upon irradiation with UV radiation of less than 300 nm wavelength, to provide a silicon release material having a tightly cross-linked epoxysilicone network. GE Silicones 1178-116 Viscosity Modifier can be used to help in forming precise patterns or discrete areas of release coating 24.

As described up to this point, security pocket 10, with its permanently bonded periphery and unique closure flap 18 will meet most commercial demands for such a product in a superior manner. If there is to be no pocket content information printed on the outside of rear panel 14, or if such information is carried on manually applied labels, or if security pocket 10 is fabricated as a fan fold product for printing, then this product is complete. However, where a need for security pockets to be printed upon by non-impact, single sheet fed printers, is required, such as commercially available ink jet and laser printers, static electricity can cause problems. Specifically, the presence of alternating transparent plastic panel 12 and paper back panel 14 results in the continual sliding of plastic against paper when sheets of security pockets 10 are fed from an input stack, through the printer, and onto the output stack. Such sliding generates static electricity, which can cause sheet jamming at both the input and output sides of the printer, as well as making it difficult to remove the printed security pockets 10 from the output stack. Standard attempts to remove or at least adequately reduce the static electrical charges have heretofore not been successful and have prevented existing security pockets from being used with non-impact sheet fed printers.

Further, where the printing is done by a laser printer, the corona of the laser generates additional static electricity charge levels, causing the paper to plastic laminate to act like an electrical capacitor which stores a relatively high voltage that can present a shock hazard to the user or printing equipment. Conventional techniques, such as grounding or shunting, to obviate or reduce the laser corona generated static electricity charge have not been successful and have further prevented the use of existing security pockets with laser printers.

A commercially available polyester film, heretofore not used in the business form industry, nor for security pockets generally, has anti-static and other properties well suited to overcome the hereinabove discussed problems. A wide range of film gauge, 0.00092 to 0.003 inches, has been used in the development of the subject transparent security pocket of this invention.

The trade name of this polyester film is Melinex 1311 and one distributor is Plastic Suppliers, 1174 Hayes Industrial Drive, Marrietta, Ga. 35062. Melinex 1311 is a clear film with anti-static properties on both surfaces of its web. Its surface resistivity, independent of gauge, is $2\times10^{10}$ ohms/square and has overcome the hereinabove discussed static electricity and laser corona based problems. Moreover this film does not suffer from unacceptable shrinkage, when passed through the high heat of the fusing stage of a laser printer. In fact, paper panel 14, in giving up some of its moisture content in the fusing stage, shrinks approximately the same as front transparent panel 12 made from Melinex 1311 film. The preferred Melinex 1311 polyester film is described in more detail in in U.S. Pat. No. 4,371,489 in the name of Patrick T. McGrall and entitled "Production of Antistatic Thermoplastic Films".

Although an individual security pocket 10 could be fabricated as a discrete item and also be fed through a printer, like a single "sheet", if the size of security pocket 10 permits, two or more security pockets 10 can be laid out side by side, with the left perimeter part 16*a* of the second pocket lying parallel to the right perimeter part 16*c* of the first pocket. A die cut line through transparent front panel 12 and a perforation through back panel 14, formed to lie between those two perimeters, but not touching their permanent adhesive bonds, allows the two security pockets 10 to be boxed more conveniently and then be separated before printing on back panel 14, or even after printing. The relative widths of the side by side security pockets configuration, the fabrication width of a single "sheet" thereof, and the sheet fed length capacity of the printer could enable several pockets to be transported through the printer as a single sheet. For example, two five and one half inch by eight and one half inch security pockets or four five and one half inch by four and a quarter inch security pockets can be fabricated on a standard size sheet of paper, which can be fed through a conventional non-impact printer using standard feeding mechanisms and paper trays. Such a multi-pocket product could be used at the end of a production line, where a series of the same items are being secured for next stage delivery; for example, each pocket could contain an extra link of an expensive gold watch band or in a hospital in which drugs are dispensed at the hospital pharmacy for patients.

It should be understood that the invention herein has been described with reference to preferred embodiments and that various alterations and variations can be made by ones skilled in the art without departing from the spirit and scope of the invention as set forth in the following claims.

What is claimed is:

1. A transparent security pocket for transporting materials from an origin to a destination in which any tampering of said materials can be visually observed, said pocket being adapted for being printed upon by a sheet fed, non-impact printer, said security pocket comprising:

a first panel of a material for accepting printing from said printer having a given size and shape;

a second panel of a transparent plastic material having an anti-static coating thereon and having said given size and shape, said first and second panels being juxtaposed with respect to one another in a co-extensive formation;

a strip of first adhesive material for permanently securing said first and second panels around a secure portion of the periphery thereof, leaving an open portion of said periphery, the ends of said strip of first adhesive material defining the interface between said open and said secure portions;

a layer of a second adhesive material affixed to an interior facing side of said first panel along the opening portion of the periphery thereof;

a layer of adhesive release material affixed to the interior facing side of said second panel coextensive with said layer of second adhesive material, a cut being placed through said second panel remote from said release material and between the ends of said strip of first adhesive material; and, a pair of perforations in said first panel, one of which is aligned with said cut and the other of which is between said one perforation and said layer of second adhesive.

2. The security pocket of claim 1, wherein said first panel comprises a paper material and said second panel comprises a clear polyester film having antistatic properties on both surfaces.

3. The security pocket of claim 2, further comprising a layer of reinforcement material between said pair of perforations.

4. The security pocket of claim 1, further comprising a layer of reinforcement material between said pair of perforations.

* * * * *